US010712047B2

(12) United States Patent
Perez et al.

(10) Patent No.: US 10,712,047 B2
(45) Date of Patent: Jul. 14, 2020

(54) METHOD OF FIELD CONVERSION OF A HEATING SYSTEM TO A MULTIPLE STAGE MODULATING GAS FIRED HEAT EXCHANGER

(71) Applicant: Lennox Industries Inc., Richardson, TX (US)

(72) Inventors: Eric Perez, Hickory Creek, TX (US); Steven Schneider, Plano, TX (US); Bryan Smith, Carrollton, TX (US); John Tran, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 788 days.

(21) Appl. No.: 14/976,485

(22) Filed: Dec. 21, 2015

(65) Prior Publication Data

US 2017/0176049 A1 Jun. 22, 2017

(51) Int. Cl.
*F24H 9/20* (2006.01)

(52) U.S. Cl.
CPC ..... *F24H 9/2085* (2013.01)

(58) Field of Classification Search
CPC ..... F24H 9/2085
See application file for complete search history.

(56) References Cited

U.S. PATENT DOCUMENTS

2008/0127963 A1* 6/2008 Thompson ..... F23N 1/062 126/116 A
2010/0001087 A1* 1/2010 Gum ..... F23N 1/005 237/2 A
2014/0030662 A1* 1/2014 Noman ..... F24H 3/087 431/12

OTHER PUBLICATIONS

U.S. Appl. No. 14/976,354, Schneider et al.
U.S. Appl. No. 16/389,017, Joyner, Jr.

* cited by examiner

*Primary Examiner* — Rick K Chang
(74) *Attorney, Agent, or Firm* — Winstead PC

(57) ABSTRACT

A heating system retrofitted to be operable through multiple heat stages at a constant fuel-air mixture includes a tube heat exchanger having a plurality of burners, a combustion air blower (CAB) having an exhaust vent connected with the plurality of burners, the CAB operable at a first speed and a second speed, a first valve connecting a fuel source to a first subset of the plurality of burners, and a second valve connecting a fuel source to a second subset of the plurality of burners.

6 Claims, 2 Drawing Sheets

METHOD OF FIELD CONVERSION OF A HEATING SYSTEM TO A MULTIPLE STAGE MODULATING GAS FIRED HEAT EXCHANGER

TECHNICAL FIELD

This application is directed, in general, to heating systems such as furnaces and more specifically to controlling the operation of the heating systems.

BACKGROUND

This section provides background information to facilitate a better understanding of the various aspects of the disclosure. It should be understood that the statements in this section of this document are to be read in this light, and not as admissions of prior art.

HVAC systems can be used to regulate the environment within an enclosure. Typically, a circulating fan is used to pull air from the enclosure into the HVAC system through ducts and push the air back into the enclosure through additional ducts after conditioning the air (e.g., heating or cooling the air). For example, a gas furnace, such as a residential gas furnace, is used in a heating system to heat the air. Some gas furnaces are modulating or two-stage gas furnaces that can operate at different input rates compared to a single stage furnace that only operates at one gas input, i.e., full heating input. The modulating furnaces can operate more efficiently compared to conventional single stage furnaces and reduce energy costs.

SUMMARY

Methods are disclosed for retrofitting heating systems, for example two-stage gas-fired heat exchangers, to have a modulating gas-fired heat exchanger that is operable through multiple heat stages at a constant fuel-air mixture. In accordance to an embodiment, a field converted heating system includes a tube heat exchanger having a plurality of burners, a combustion air blower (CAB) having an exhaust vent connected with the plurality of burners, the CAB operable at a first speed and a second speed, a first valve connecting a fuel source to a first subset of the plurality of burners, and a second valve connecting a fuel source to a second subset of the plurality of burners, wherein the first and second valves each have a low fire rate and a high fire rate and the heat exchanger is operable through multiple heat stages at a constant fuel-air mixture at each burner.

In accordance to aspects a heating system, after being retrofitted, has a heat exchanger comprising burners to burn a combustible fuel-air mixture, a combustion air blower (CAB) operable at a low speed and a high speed to supply air to the burners, a first subset of the burners connected to a fuel source through a first valve to control a fuel input rate to the first subset of the burners, a second subset of the burners connected to the fuel source through a second valve to control a fuel input rate to the first subset of the burners, wherein the first valve and the second valve each have an off position, a low fire rate, and a high fire rate and the burners are operated in a low fire mode at the low speed and the low fire rate and operated in a high fire mode at the high speed and the high fire rate and the heat exchanger is operable through multiple heat stages.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
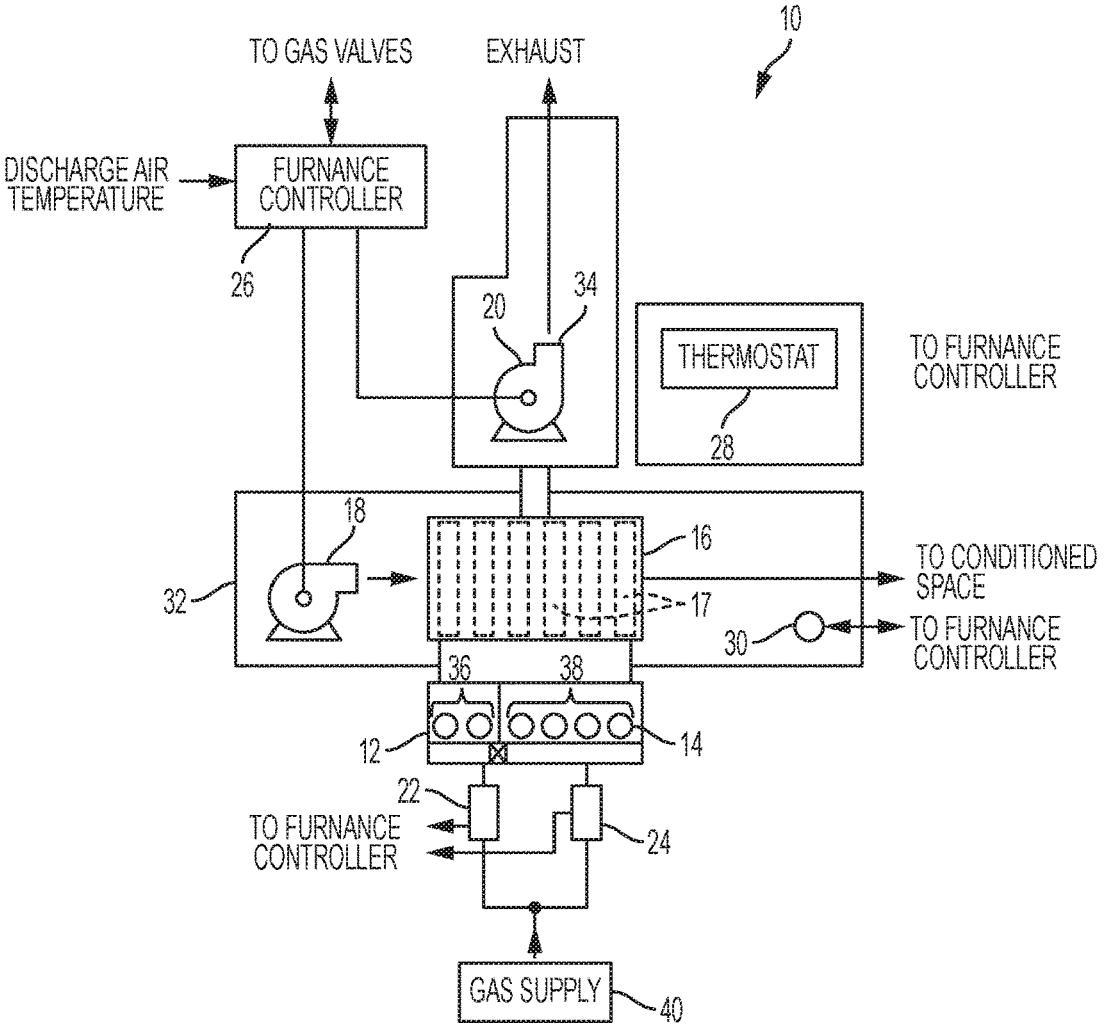
FIG. 1 is a diagram of a modulating heating system according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

FIG. 1 is a diagram of an embodiment of a heating unit or system, generally denoted by the numeral 10, in accordance to embodiments of the disclosure. The heating system 10 is for example a gas fired combustible fuel-air burning furnace. The furnace may be for a residence or for a commercial building (i.e., a residential or commercial unit), for example a rooftop unit (RTU). In accordance to an embodiment, heating system 10 is a two-stage furnace having a two-stage control that has been retrofitted, or upgraded, to be a multiple staged modulated system.

Heating system 10 includes a burner assembly 12 having a plurality of burners 14, a heat exchanger 16, an air circulation fan 18, a combustion air inducer or combustion air blower (CAB) 20, a first gas valve 22, and a second gas valve 24, and a furnace controller 26. The furnace controller 26 is operationally connected for example to CAB 20, gas valves 22 and 24, a thermostat 28 and a discharge air sensor (DAS) 30. The heating system may be utilized in single or multiple zoned systems. Portions of the heating system 10 may be contained within a cabinet 32. In some embodiments, the furnace controller may be included in the cabinet. One skilled in the art will with benefit of this disclosure will understand that the heating system may include additional components and devices that are not presently illustrated or discussed.

The burner assembly 12 includes a plurality of burners 14 that are configured for burning a combustible fuel-air mixture (e.g., gas-air mixture) and to provide a combustion product to the heat exchanger 16. The heat exchanger includes tubes 17, for example a tube corresponding to each burner. The heat exchanger 16 is configured to receive the combustion product from the burner assembly and use the combustion product to heat air that is blown across the heat exchanger by the circulation fan 18. The circulation fan 18 is configured to circulate air through the cabinet 32, whereby the circulated air is heated by the heat exchanger and supplied to the conditioned space. The CAB 20 is configured to supply combustion air to the burner assembly 12 (i.e., the plurality of burners 14) by an induced draft and is also used to exhaust waste products of combustion from the furnace through a vent 34. In accordance to aspects of the disclosure the CAB 20 is operable at two speed settings, low speed and high speed, corresponding to two modes of operation of the burners, low fire and high fire. The CAB 20 is configured so that the low speed and the high speed correspond respectively to the low fire gas rate and the high fire gas rate to provide gas-fuel mixture for the low fire and high fire modes of the heat exchanger. In accordance to embodiments, the fuel-air mixture is constant through the multiple heating stages.

Figure 2:
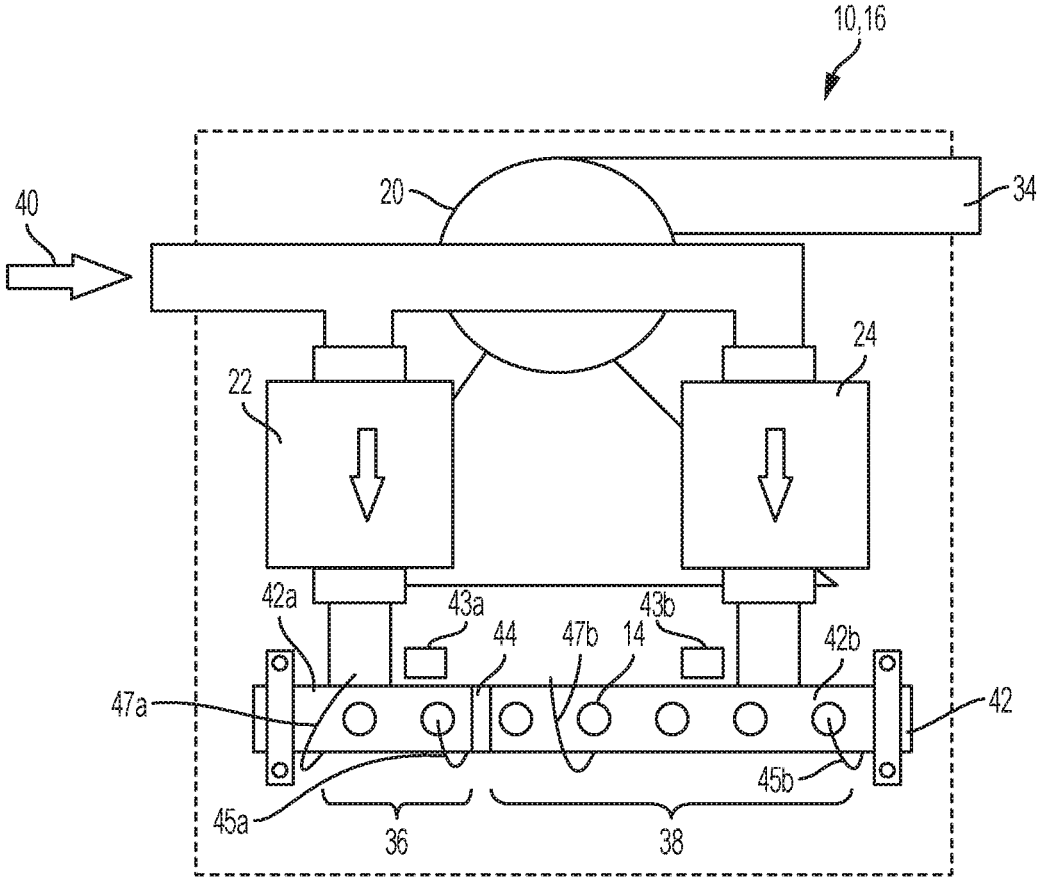
FIG. 2 illustrates an interface with a gas fired heat exchanger according to one or more aspects of the disclosure.

With additional reference to FIG. 2, the burners 14 are separated into subsets of a burners and each subset of burners is connected to a fuel source 40, i.e., gas, through a respective gas valve ("GV"). It may be said that the heat exchanger is divided into subsets utilizing a common CAB with each subset of the heat exchanger connected to the fuel source or supply through a respective gas valve. For example, with reference to FIGS. 1 and 2 the burners 14 of the heat exchanger are separated into a first subset 36 and a second subset 38. The first subset 36 of burners 14 is connected to the fuel source 40 through the first gas valve 22 and the second subset 38 of burners is connected to the fuel source 40 through the second gas valve 24. The burner assembly may include a manifold 42 connected directly to the burners for supplying the fuel 40 to more than one burner at a time. The manifold 42 can include a block 44, i.e., plug, to separate the burners into subsets. For example in FIG. 2 the plug 44 separates the manifold into a first section 42*a* and a second section 42*b*. The fuel supply 40 is connected through the first gas valve 22 to the first section 42*a* and the first subset 36 of burners and connected through the second gas valve 24 to the second section 42*b* and the second subset 38 of burners.

In accordance to aspects of the disclosure the first and second gas valves are each operable to an off position blocking gas flow, a low fire rate allowing a first flow rate of gas to be input to the burners, and a high fire rate allowing a second flow rate of gas to be input to the burners, i.e., two-stage valves. In accordance to aspects, the gas input per burner both on low fire and high fire remains about the same as current eighty-one percent annual fuel utilization efficient (AFUE) products. When a burner is in a low fire mode the respective gas valve is at the low fire rate and the CAB 20 (FIG. 1) is on the low speed and when the burner is in a high fire mode the respective gas valve is at the high fire rate and the CAB is at the high fire rate.

The modulated heating system 10 utilizes burners 14 connected through a common vent 34 of the CAB 20. The heating system 10 can be modulated through multiple heat input stages while supplying a constant fuel-air ratio to the burners through all the heating stages or steps. Accordingly, the heating system is not modulated by changing the fuel-air ratio and the system does not utilize complicated variable speed induced blowers and/or variable pressure gas regulators, also referred to as modulating gas valves. These typical modulating heating systems require complicated software and expensive controls that are required to maintain air-fuel ratios in certain ranges. If air-fuel ratios are not properly controlled this can result in reduction of heat exchanger thermal efficiency, excessive heat exchanger corrosion, difficulty in lighting and the formation of toxic combustion flue products that contain high levels of carbon monoxide. Utilizing two gas valves and two subsets of burners the heating system can be modulated through six stages. Subsequently adding a third gas valve and an additional subset of burners can be modulated through 10 discrete steps or stages of gas heat input. The gas valves 22, 24 and their respective subsets of burners are operated in parallel providing increased reliability. For example, if one gas valve fails the other gas valve can still be operated. Further, the modulating does not utilize variable pressure modulating gas valves.

The first and second subsets 36, 38 have different numbers of burners as will be understood by those skilled in the art with benefit of this disclosure. For example, in FIG. 2 the first subset 36 includes two burners and the second subset 38 includes five burners. As will be understood by those skilled in the art with benefit of this disclosure, the ratio of burners to gas valve can be adjusted to change the discrete control of the heating system. As further disclosed below, the heating system 10 can be modulated for example up to six stages utilizing two subsets and two gas valves or ten stages by adding another subset of burners and another gas valve. In accordance to an embodiment, a modulated heating system 10 can achieve a turn down ratio of five to one (5:1). The turndown ratio is the operation range of system, for example the ratio of the maximum output to the minimum output. In accordance to one or more embodiments the turndown ratio of modulated heating system 10 is about 7.5 to one. The heating system 10 can be configured with more than two subsets of burners each with a respective gas valve and utilizing a common CAB and vent, which will increase the number of available stages and increase the turn-down ratio. Burner subsets and numbers of burners assigned on each subset are optimized with the number of input stage so each discrete gas input stages provides close to equal heating increments as possible, to prevent overheating the discharge air.

The first and second gas valves 22, 24 are described above as single two-stage valves. However, it should be recognized that each of the gas valves 22, 24 may include a first and second single stage valve without departing from the scope of this disclosure. For example, the first gas valve 22 may include a low fire valve and a high fire valve. In response to a low fire rate signal the low fire valve would open and in response to a high fire rate signal both the low fire and the high fire valves would open.

The ignition system includes one or more ignition switches or controllers denoted generally with the numeral 43, one or more igniters denoted generally with the numeral 45 and one or more flame sensors generally denoted with the numeral 47. FIG. 2 depicts a system having a first ignition controller 45*a*, a first igniter 45*a* and first flame sensor 45*a* located with the first subset of burners and a second ignition controller 43*b*, a second igniter 45*b* and a second flame sensor 47*b* located with the second subset of burners. The system can transition up and down the gas inputs with essentially zero lag between the stages as long as one stage remains lit. Transition from one set of burner subsets to another occurs using flame carry over from the lit burners to the un-lit burners, this happens very quickly as the flame speed is in excess of 20 cm/s with almost no delay.

Figure 3:
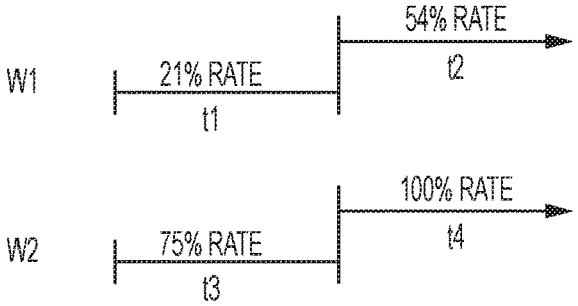
FIG. 3 is a graph illustrating a tunable staged modulating gas fired heat exchanger in accordance to one or more embodiments.

In accordance to some embodiments a lighting or ignition sequence includes a single ignition controller, e.g., ignition controller 43*a*, used with a single flame sensor, e.g. sensor 47*a*, and a single flame igniter, e.g., flame igniter 45*b*, either spark or hot surface. The unit controller 26 has a pre-programmed ignition sequence that includes fully energizing all the burner subsets so that ignition is created at one extreme end, i.e., at flame igniter 45*b*, of the gas manifold and the flame is confirmed to be present by the use of a flame sensor, i.e., sensor 47*a*, at the other extreme end of the gas manifold. The flame sensor will be located at the stage one-gas input or the input step with the lowest burner count. When there is a heat demand for the first time in a heating cycle the controller will energize all the burner sub-sets and the gas valves in order to prove that there is a continuous flame path from the flame igniter to the flame sensor. Immediately after the flame is sensed the other gas valve(s) associated with gas delivery to the other burner-subset(s) will be de-energized. At this point the system will respond to demand signals as shown in FIG. 3, staging up as t1, t2 timers and the thermostat signals W1 and W2 deem necessary. If the thermostat transitions from W2 back to W1 the unit will start back at the lowest heat input to prevent overheating the occupied space and to prevent the thermostat demand from cycling off directly after W2. The purpose of the control circuit is to increase the amount of time the burners are on so that the system can effectively respond instantly to a thermostat demand for additional heat.

In accordance to another embodiment, dedicated ignition controllers 43*a* and 43*b* are associated with each burner subset. The dedicated ignition controllers 43*a* and 43*b* communicate with respective single dedicated flame igniters 45*a* and 45*b* and single dedicated flame sensors 47*a* and 47*b*. The each ignition system then independently controls the gas valve that feeds fuel to each of the burner subsets. Each ignition controller would be responsible to produce a spark, flame and prove the flame from one end of the burner subset to the opposite end of burner subset.

Operation of a heating system 10 through multiple operational, or heating, stages is now described with reference to Tables 1 and 2 below. The heating system 10 described with reference to Table 1 includes seven burners 14 connected through a single CAB 20 to a common vent 34. The first subset 36 of burners includes two burners 14 connected to a first gas valve 22 (GV1) and the second subset 38 includes five burners connected through a second gas valve 24 (GV2). One skilled in the art with benefit of this disclosure will recognize that although six stages are available, the system may be implemented (e.g., via controller 26) to utilize less than six stages, for example four stages.

TABLE 1

| | | | First Subset 36 | | Second Subset 38 | | | | |
|---|---|---|---|---|---|---|---|---|---|
| Heat Stage | % of Input | CAB | GV1 Burner 1 | GV1 Burner 2 | GV2 Burner 1 | GV2 Burner 2 | GV2 Burner 3 | GV2 Burner 4 | GV2 Burner 5 |
| 1 | 20 | Low | Low | Low | | | | | |
| 2 | 29 | High | High | High | | | | | |
| 3 | 54 | Low | | | Low | Low | Low | Low | Low |
| 4 | 71 | High | | | High | High | High | High | High |
| 5 | 75 | Low | Low | Low | Low | Low | Low | Low | Low |
| 6 | 100 | High | High | High | High | High | High | High | High |

As shown in Table 1 the heating system may be operated through six stages, for example by the controller 26, in responses to heat calls. In stage 1 the first subset of burners are in the low fire mode and the second subset of burners are off. In the second stage the first subset of burners are in the high fire mode and the second subset of burners are off. In the third stage the first subset of burners are off and the second subset of burners are in the low fire mode. In the fourth stage the first subset of burners are off and the second subset of burners are in the high fire mode. In the fifth stage the first subset of burners are in the low fire mode and the second subset of burners are in the low fire mode. In the sixth stage the first subset of burners are in the high fire mode and the second subset of burners are in the high fire mode.

TABLE 2

| Heat Stage | GV1 Input/Burner (1,000 BTU/hr) | GV2 Input/Burner (1,000 BTU/hr) | Burners GV1 | Burners GV2 | Input GV1 (1,000 BTU/hr) | Input GV2 (1,000 BTU/hr) | Total Input (1,000 BTU/hr) | Firing Rate (% of Input) |
|---|---|---|---|---|---|---|---|---|
| 1 | 15 | 0 | 2 | 5 | 30 | 0 | 30 | 20 |
| 2 | 20 | 0 | 2 | 5 | 40 | 0 | 40 | 29 |
| 3 | 0 | 15 | 2 | 5 | 0 | 75 | 75 | 54 |
| 4 | 0 | 20 | 2 | 5 | 0 | 100 | 100 | 71 |
| 5 | 15 | 16 | 2 | 5 | 30 | 75 | 105 | 75 |
| 6 | 20 | 20 | 2 | 5 | 40 | 100 | 140 | 100 |

Table 2 illustrates calculation of the firing rate of the heating system for each stage. The second column of Table 1 and the last column of Table 2 show that the heating system achieves a turndown ratio of about 5:1 or about 20 percent of input. The gas orifice size on the lesser heat input may be tuned to compensate for any change to CAB flow characteristics when operating at a lower flue temperature and this may result in a different turndown ratio. Table 1 indicates an eighty-one percent (81%) AFUE at the lowest input condition of stage 1, with two burners operating at a twenty-one percent (21%) input rate (BTU/hr.).

Table 3 below illustrates the firing rate for stages of a heating system having five burners 14, i.e., a five tube heat exchanger, connected through a common vent and separated into two subsets of burners. In this example the first subset 36 includes two burners 14 connected through a first gas valve 22 (GV1) and a second subset 38 of three burners 14 connected through a second gas valve 24 (GV2). This five burner arrangement achieves a turndown ratio to about 3:1.

TABLE 3

| Heat Stage | GV1 Input/Burner (1,000 BTU/hr) | GV2 Input/Burner (1,000 BTU/hr) | Burners GV1 | Burners GV2 | Input GV1 (1,000 BTU/hr) | Input GV2 (1,000 BTU/hr) | Total Input (1,000 BTU/hr) | Firing Rate (% of Input) |
|---|---|---|---|---|---|---|---|---|
| 1 | 15 | 0 | 2 | 3 | 30 | 0 | 30 | 33 |
| 2 | 20 | 0 | 2 | 3 | 40 | 0 | 40 | 40 |
| 3 | 0 | 15 | 2 | 3 | 0 | 45 | 45 | 45 |
| 4 | 0 | 20 | 2 | 3 | 0 | 60 | 60 | 60 |
| 5 | 15 | 16 | 2 | 3 | 30 | 45 | 75 | 75 |
| 6 | 20 | 20 | 2 | 3 | 40 | 60 | 170 | 100 |

Table 4 below illustrates the firing rate for stages of a heating system 10 having eleven burners 14, i.e., eleven tube heat exchanger, connected through a common vent and separated into two subsets of burners. In this example the first subset includes three burners connected through a first gas valve (GV1) and a second subset of eight burners connected through a second gas valve (GV2). Similar to the seven burner system of Tables 1 and 2, the eleven burner arrangement in Table 3 achieves a turndown ratio of about 5:1.

TABLE 4

| Heat Stage | GV1 Input/Burner (1,000 BTU/hr) | GV2 Input/Burner (1,000 BTU/hr) | Burners GV1 | Burners GV2 | Input GV1 (1,000 BTU/hr) | Input GV2 (1,000 BTU/hr) | Total Input (1,000 BTU/hr) | Firing Rate (% of Input) |
|---|---|---|---|---|---|---|---|---|
| 1 | 15 | 0 | 3 | 8 | 45 | 0 | 45 | 20 |
| 2 | 20 | 0 | 3 | 8 | 60 | 0 | 60 | 27 |
| 3 | 0 | 15 | 3 | 8 | 0 | 120 | 120 | 55 |
| 4 | 0 | 20 | 3 | 8 | 0 | 160 | 160 | 73 |
| 5 | 15 | 15 | 3 | 8 | 45 | 120 | 165 | 75 |
| 6 | 20 | 20 | 3 | 8 | 60 | 160 | 220 | 100 |

Most commercial thermostats are only available with two-stage gas heating stages. The majority of the gas heating products are sized around peak periods of the year where maximum heat input is required. The means that under a large portion of the heating season the products are cycled more frequently and high discharge air temperatures can create issues with the comfort of the conditioned space. The heating system 10 has a control system that is capable of allowing users the benefits of a four stage step modulated heating system. The control is comprised of timers, see, e.g., electronics 50 (FIG. 4), that will allow the unit to stage up to the next available heat increment based on the amount of time that the thermostat delivers a heating demand. The system allows users to operate a series of adjustable timers that allow installers to tune the delay before the system stages up to the next available heat input level. This will allow the system to match the heat-load of the occupied space and provide better comfort than typical 2-stage systems that tend to overheat the discharge air and create large temperature swings in the conditioned space. Timers also function in reverse order and will allow the unit to stage down from a higher input to a lower input as required. Any time the thermostat delivers a call for high-heat the system will start at stage 3 and will cycle to stage 4 after timer t3 has expired. FIG. 3 is a graph illustrating the benefits of a tunable staged modulating heating system 10 (i.e., gas fired heat exchanger), wherein "W1" is a first heating call (low heat demand) and "W2" is a second heating call (high heat demand). FIG. 3 illustrates four heating stages utilizing a heating system 10 as described for example with reference to Tables 2-4.

Table 5 below illustrates the firing rate for stages of a heating system 10 having eleven burners 14, i.e., eleven tube heat exchanger, connected through a common vent and separated into two subsets of burners. In this example the first subset 36 includes two burners connected through a first gas valve 22 (GV1) and a second subset of nine burners connected through a second gas valve (GV2). This arrangement indicates a low stage firing rate of about fourteen percent (14%) and a turndown ratio of about 7.5:1.

TABLE 5

| Heat Stage | GV1 Input/Burner (1,000 BTU/hr) | GV2 Input/Burner (1,000 BTU/hr) | Burners GV1 | Burners GV2 | Input GV1 (1,000 BTU/hr) | Input GV2 (1,000 BTU/hr) | Total Input (1,000 BTU/hr) | Firing Rate (% of Input) |
|---|---|---|---|---|---|---|---|---|
| 1 | 15 | 0 | 2 | 9 | 30 | 0 | 30 | 14 |
| 2 | 20 | 0 | 2 | 9 | 40 | 0 | 40 | 18 |
| 3 | 0 | 15 | 2 | 9 | 0 | 135 | 135 | 61 |
| 4 | 0 | 20 | 2 | 9 | 0 | 180 | 180 | 82 |
| 5 | 15 | 15 | 2 | 9 | 30 | 135 | 165 | 75 |
| 6 | 20 | 20 | 2 | 9 | 40 | 180 | 220 | 100 |

The furnace controller 26 is configured to control the operation of the heating system 10 including the combustion air blower 20 and the circulation fan 18, respectively. Additionally, furnace controller controls operation of the gas valves (i.e., valves 22, 23). As discussed above, the controller can operate the CAB 20 and the respective gas valves to their respective low speed and low fire rate and high speed and high fire rate to achieve the desired burner mode (low fire or high fire) for each operational stage of the heating system 10 without using look-up tables or modulating the gas flow rate.

The furnace controller 26 may include a memory section having a series of operating instructions stored therein that direct the operation of the furnace controller 126 (e.g., the processor) when initiated thereby. The series of operating instructions may represent algorithms that are used to prevent or reduce temperature overshooting in the conditioned space. The furnace controller 26 also includes or communicates with a delay timer. The delay timer can be a conventional clock that can be reset and can be used to keep track of a designated amount of time that is used to allow settling of discharge air temperatures. As illustrated in FIG. 1, the controller 26 is coupled to the DAS 30, the thermostat 28 and components of the heating system. The controller 26 may also be connected to other elements and systems, such as a zone controller. In some embodiments, the connections are through a wired-connection. A conventional cable and contacts may be used to couple the controller to the various components of the heating system. In some embodiments, a wireless connection may also be employed to provide at least some of the connections.

The DAS 30 is a temperature sensor that is designated and positioned to determine the discharge air temperature of the heating system. The DAS 30 may be a conventional temperature sensor configured to determine the ambient temperature of the area where positioned and provide this temperature data to the controller 26 to use in directing the operation of the heating system. In FIG. 1, the DAS is located in the cabinet. In other embodiments, the DAS can be positioned in other locations to measure the discharge air temperature of the heating system. For example, the DAS can be positioned in a duct between the cabinet and the conditioned space. In some embodiments, multiple temperature sensors can be used and an average discharge air temperature determined therefrom. The discharge air sensor 30 can be, for example, a 10 k Negative Temperature Coefficient (NTC) sensor.

The thermostat(s) 20 can be a conventional thermostats employed in HVAC systems that generate heating calls based on temperature settings. The thermostat is a user interface that allows a user to input a desired temperature for a designated area or zone of the conditioned space. Thermostat(s) 20 may be a two-stage thermostat. In retrofit applications the modulating system is compatible with two-stage thermostats.

Aspects of this disclosure may be utilized for retrofit applications. For example, currently it is known for heating, ventilation and air conditioning (HVAC) systems to be retrofitted with modulating gas valve controls. The thermal efficiency of the heat exchanger is reduced with these retrofitted modulating gas valve controls and should also require modulating the CAB to be in AFUE compliance. The tunable modulating system disclosed herein provides a mechanism to retrofit current HVAC systems to achieve a higher turndown ratio while maintaining AFUE compliance, and providing more discreet heating control. As described above the retrofit heating system 10 can be modulated through multiple stages while maintaining a constant fuel-air mixture through the stages.

Figure 4:
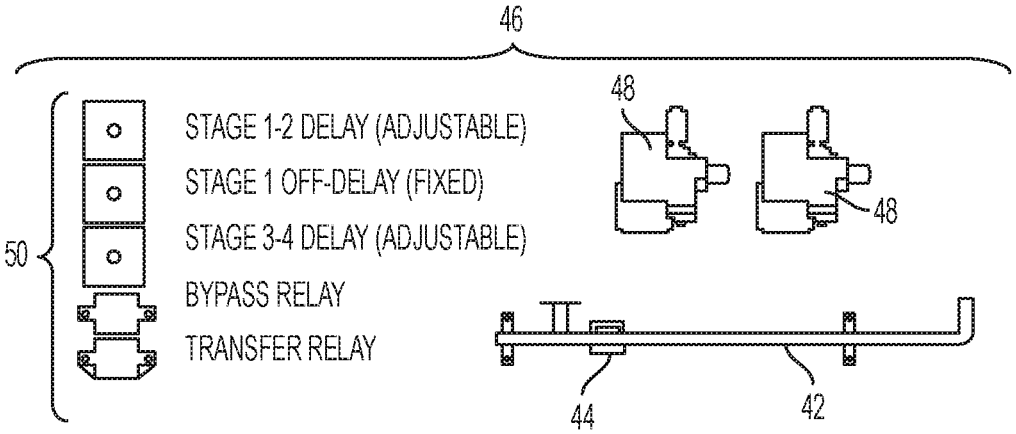
FIG. 4 illustrates a retrofit or field conversion kit for converting a gas fired heat exchanger to a modulating gas fired heat exchanger according to one or more aspects of the disclosure.

In accordance to embodiments a field conversion kit may be provided for retrofitting a unit, such as a two-stage furnace having a two-stage control, to be a multiple staged modulated system. FIG. 4 illustrates elements that may be included in a tunable modulating system retrofit kit 46 in accordance to one or more aspects. The retrofit kit 46 may include, for example, and without limitation one or more gas valves, generally denoted by the numeral 48, to be installed as one or more gas valves 22, 24 in FIG. 1, a manifold 42 having a block 44, and electronic elements, generally denoted by the numeral 50, for installation in the unit controller 26 (FIG. 1). The electronics may include various elements such as timers, relays as well as ignition controllers and the like. A retrofit kit 46 may include only one two-stage valve 48 as the heat exchanger to be upgraded, i.e., retrofitted, may already include one two-stage gas valve.

Accordingly, methods are disclosed for retrofitting a heating system to have a modulating gas-fired heat exchanger that is operable through multiple heat stages at a constant fuel-air mixture, wherein the heating system includes the heat exchanger having burners, a combustion air blower (CAB) having an exhaust vent connected with the burners, and a first valve connecting a fuel source to the burners, the first valve operable at a low fire rate and a high fire rate, and a controller connected to the CAB and the first valve to operate the burners between a low fire mode and a high fire mode. In accordance to an embodiment the retrofitting includes connecting a first subset of the burners to the fuel source through the first valve and connecting a second subset of the burners to the fuel source through a second valve, wherein the second valve is operable at the low fire rate and the high fire rate. In accordance to embodiments, the controller of the heating system can be connected to the second valve such that the first gas valve and the second gas valve can be operated independent and in parallel to provide for multiple, e.g., more than two, heat stages that are operated at a constant fuel-air ratio. The retrofitting may include reprogramming the controller and or adding electronics 50, such as and without limitation, relays and timers.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method, comprising:

retrofitting a heating system to have a modulating gas-fired heat exchanger that is operable through multiple heat stages at a constant fuel-air mixture, wherein the heating system includes the heat exchanger having burners on a manifold, a combustion air blower (CAB) having an exhaust vent connected with the burners, and a first valve connecting a fuel source to the burners, the first valve comprising a first flow configuration, the first flow configuration consisting of a closed setting, a low-flow setting, and a high-flow setting, and a controller connected to the CAB and the first valve to operate the burners between a low fire mode and a high fire mode, the retrofitting comprising:

connecting a first subset of the burners on the manifold to the fuel source through the first valve and connecting a second subset of the burners on the manifold to the fuel source through a second valve, the second valve comprising a second flow configuration, the second flow configuration consisting of a closed setting, a low-flow setting, and a high-flow setting; and wherein the first valve and the second valve are upstream in relation to the manifold.

2. The method of claim 1, wherein the multiple stages comprise more than two heat stages.

3. The method of claim 1, wherein the multiple heat stages comprises four or more heat stages.

4. The method of claim 1, wherein the multiple heat stages comprise a low fire stage having a fuel input rate of about twenty-one percent or less.

5. The method of claim 1, wherein the retrofitting comprises connecting the controller to the second valve whereby the first valve and the second valve can be operated independent of one another.

6. The method of claim 1, wherein the retrofitting comprises adding electronic relays to the controller and connecting the controller to the second valve whereby the first valve and the second valve can be operated independent of one another.

* * * * *